US006013981A

United States Patent [19]

Spindt et al.

[11] Patent Number: 6,013,981

[45] Date of Patent: Jan. 11, 2000

[54] HIGH VOLTAGE COMPATIBLE SPACER COATING

[75] Inventors: Christopher J. Spindt, Menlo Park; George B. Hopple, Palo Alto, both of Calif.

[73] Assignee: Candescent Technologies, Inc., San Jose, Calif.

[21] Appl. No.: 09/124,460

[22] Filed: Jul. 28, 1998

Related U.S. Application Data

[62] Division of application No. 08/883,409, Jun. 26, 1997, Pat. No. 5,872,424.

[51] Int. Cl.[7] ..... H01J 1/62

[52] U.S. Cl. ..... 313/495; 313/292; 313/422

[58] Field of Search ..... 313/495, 292, 313/422

[56] References Cited

U.S. PATENT DOCUMENTS

| | | | |
|---|---|---|---|
| 5,760,538 | 6/1998 | Mitsutake et al. | 313/422 |
| 5,872,420 | 2/1999 | Itoh et al. | 313/495 |

*Primary Examiner*—Vip Patel

*Attorney, Agent, or Firm*—Wagner, Nurabito & Hao LLP

[57] ABSTRACT

A coating material having specific resistivity and secondary emission characteristics. The coating material described herein is especially well-adapted for coating a spacer structure of a flat panel display. In one embodiment, the coating material is characterized by:

a sheet resistance, $\rho_{sc}$, and an area resistance, r, wherein $\rho_{sc}$ and r are defined as:

$$\rho_{sc}>100(\rho_{sw}) \text{ and } r<\rho_{sw}(l^2/8).$$

In the present embodiment, $\rho_{sw}$ is the sheet resistance of a spacer to which the coating material is adapted to be applied, and l is the height of the spacer to which the coating material is adapted to be applied. By having a coating material with such characteristics, the present invention eliminates the need to place rigorous secondary emission characteristic requirements on the material comprising the spacer structure in a flat panel display. More specifically, the present invention eliminates the need for the spacer material to meet rigorous secondary emission characteristic requirements in addition to meeting requirements such as, for example, high strength, precise resistivity, low TCR, precise CTE, accurate mechanical dimensions and the like.

6 Claims, 7 Drawing Sheets

HIGH VOLTAGE COMPATIBLE SPACER COATING

This application is a division of Ser. No. 08/883,409 filed Jun. 26, 1997 now U.S. Pat. No. 5,872,424.

TECHNICAL FIELD

The present claimed invention relates to the field of flat panel displays. More specifically, the present claimed invention relates to a coating material for a spacer structure of a flat panel display.

BACKGROUND ART

In some flat panel displays, a backplate is commonly separated from a faceplate using a spacer structure. In high voltage applications, for example, the backplate and the faceplate are separated by spacer structures having a height of approximately 1–2 millimeters. For purposes of the present application, high voltage refers to an anode to cathode potential greater than 1 kilovolt. In one embodiment, the spacer structure is comprised of several strips or individual wall structures each having a width of about 50 microns. The strips are arranged in parallel horizontal rows with each strip extending across the width of the flat panel display. The spacing of the rows of strips depends upon the strength of the backplate and the faceplate and the strips. Because of this, it is desirable that the strips be extremely strong. The spacer structure must meet a number of intense physical requirements. A detailed description of spacer structures is found in commonly-owned co-pending U.S. patent application Ser. No. 08/683,789 by Spindt et al. entitled "Spacer Structure for Flat Panel Display and Method for Operating Same". The Spindt et al. application was filed Jul. 18, 1996, and is incorporated herein by reference as background material.

In a typical flat panel display, the spacer structure must comply with a long list of characteristics and properties. More specifically, the spacer structure must be strong enough to withstand the atmospheric forces which compress the backplate and faceplate towards each other (In a diagonal 10-inch flat panel display, the spacer structure must be able to withstand as much as a ton of compressing force). Additionally, each of the rows of strips in the spacer structure must be equal in height, so that the rows of strips accurately fit between respective rows of pixels. Furthermore, each of the rows of strips in the spacer structure must be very flat to insure that the spacer structure provides uniform support across the interior surfaces of the backplate and the faceplate. The spacer structure must also have a coefficient of thermal expansion (CTE) which closely matches that of the backplate and faceplate to which the spacer structure is attached (For purposes of the present application, a closely matching CTE means that the CTE of the spacer structure is within approximately 10 percent of the CTE of the faceplate and the backplate to which the spacer structure is attached). The temperature coefficient of resistance (TCR) of the spacer structure must also be low. An acceptable spacer structure must meet all of the above-described physical requirements and must be inexpensive to manufacture with a high yield. Besides the physical requirements set forth above, the conventional spacer structure must also meet several electrical property requirements. Specifically, a spacer structure must have specific resistance and secondary emission characteristics, and have a high resistance to high voltage breakdown.

In conventional prior art spacer structures, an insulating material such as alumina is covered with a coating. In such prior art spacer structures, the insulating material has a very high sheet resistance, while the coating has a lower sheet resistance. Other prior art approaches utilize a spacer structure in which both the insulating material and the overlying coating have a very high sheet resistance.

Thus, due to the large number of stringent physical requirements on the bulk of the spacer structure (i.e., high strength, precise resistivity, low TCR, precise CTE, accurate mechanical dimensions etc.) it is desirable to separate out the additional requirements on the properties of the surface. Hence, a need exists for a spacer structure which meets the above-described physical and electrical property requirements without dramatically complicating and/or increasing the cost of the spacer structure manufacturing process.

DISCLOSURE OF THE INVENTION

The present invention eliminates the requirement for a spacer material to meet specific secondary emission characteristics in addition to meeting requirements such as, for example, high strength, precise resistivity, low TCR, precise CTE, accurate mechanical dimensions and the like. The present invention further achieves a spacer structure which meets the above-described physical, electrical, and emission property requirements without dramatically complicating and/or increasing the cost of the spacer structure manufacturing process. The present invention achieves the above accomplishments with a coating material which is applied to a spacer body. In addition, the present invention achieves the above accomplishments without stringent CTE, TCR, resistivity, or uniformity requirements on the coating. The present invention also points out advantages of having a spacer body which is resistive, and a spacer coating which has a sheet resistance which is higher than that of the spacer body.

Specifically, in one embodiment, the present invention provides a coating material having specific resistivity, thickness, and secondary emission characteristics. The coating material of the present embodiment is especially well-adapted for coating a spacer structure of a flat panel display. In this embodiment, the coating material is characterized by:

a sheet resistance, $\rho_{sc}$, and an area resistance, r, wherein $\rho_{sc}$ and r are approximately defined by:

$$\rho_{sc}>100(\rho_{sw}) \text{ and } r<\rho_{sw}\,(l^2/8).$$

In the present embodiment, $\rho_{sw}$ is the sheet resistance of a spacer structure to which the coating material is adapted to be applied, and l is the height of the spacer structure to which the coating material is adapted to be applied. The bulk sheet resistance $\rho_{sw}$ is defined here as the resistance of the structure divided by the height and multiplied by the perimeter. For the purpose of the present application, the word "perimeter" refers to the uppermost surface of a wall. In the present embodiment, the sheet resistance, $\rho_{sw}$, of said spacer has a value of approximately $10^{10}$ to $10^{13}$ Ω/□. By having a coating material with such characteristics, the present invention eliminates the need to place rigorous secondary emission characteristic requirements on the bulk material comprising the spacer structure in a flat panel display.

In order to avoid stringent requirements on the value or the uniformity of the coating, the sheet resistance, $\rho_{sc}$, it is desirable to have its value be high compared to $\rho_{sw}$, that is:

$$\rho_{sc}>\text{approximately } 100(\rho_{sw})$$

As in the previous embodiment, $\rho_{sw}$ is the sheet resistance of the spacer structure to which the coating material is adapted to be applied. Additionally, the coating material of the present embodiment has an area resistance, r, wherein r is defined as:

$$\Delta V_{cc}/j_c$$

$\Delta V_{cc}$, of the present embodiment is the voltage across the thickness of the coating at a current density $j_c$ where the $\Delta V_{cc}$ used to characterize r for a typical HV display is in the range of approximately 1–20 volts. In this embodiment, $j_c$ is defined as:

$$\int j_{inc}(E)\,(1-\delta(E))\,dE.$$

In the above relationship, $j_{inc}(E)$ is the electron current density, as a function of incident energy E, incident to the coating material; and δ is the secondary emission ratio of the coating material as a function of the energy E of electrons incident on the coating material. $\Delta V_{cc}$ and $j_c$ could be measured by sample currents and energy shifts in peaks using, for example, Auger electron or photoelectron spectroscopy. As in the previous embodiment, by having a coating material with such characteristics, the present invention eliminates the need to place rigorous requirements on secondary emission characteristics of the material comprising the spacer structure of a flat panel display. It also allows for tailoring the resistivity and other properties of the spacer without strict requirements on δ, and tailoring of the coating without strict requirements on resistivity.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention. Additionally, although the following discussion specifically mentions spacer walls, it will be understood that the present invention is also well suited to the use with various other support structures including, but not limited to, posts, crosses, pins, wall segments, T-shaped objects, and the like.

Figure 1:
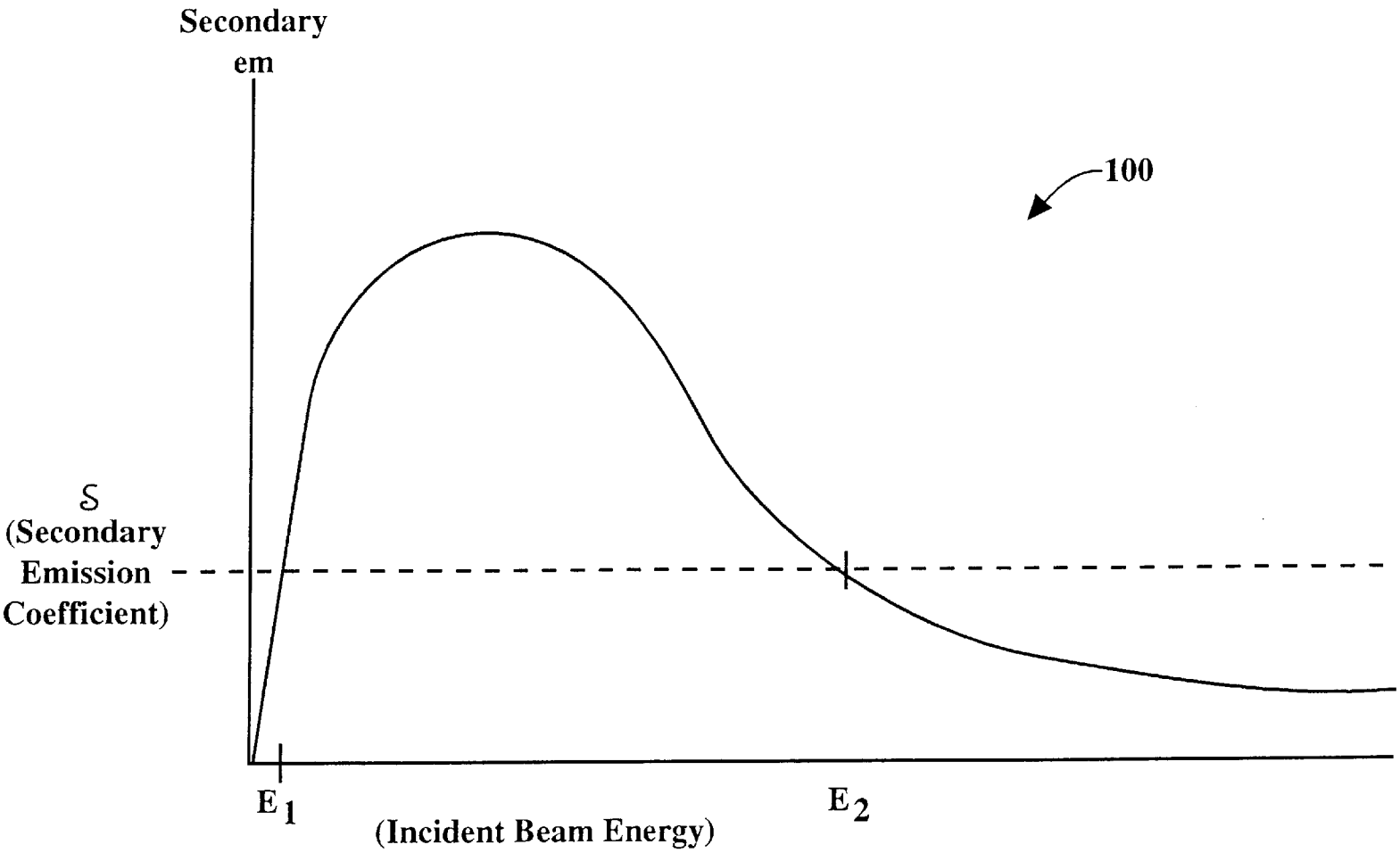
FIG. 1 is a graph of a typical secondary emission coefficient (δ) vs. incident beam energy (E) impinging on a coating material.

Referring now to FIG. 1, a typical graph 100 of the secondary emission coefficient (δ) vs. the incident beam energy (E) impinging a coating material at some angle or angles is shown. In order for a spacer structure to remain "electrically invisible" (i.e. not deflect electrons passing from the row electrode on the backplate to pixel phosphors on the faceplate), the present invention covers the spacer structure with coating material having specific resistivity and secondary emission characteristics. Also indicated are the first and second "crossover" energies where δ=1 (i.e. $E_1$ and $E_2$).

Figure 2:
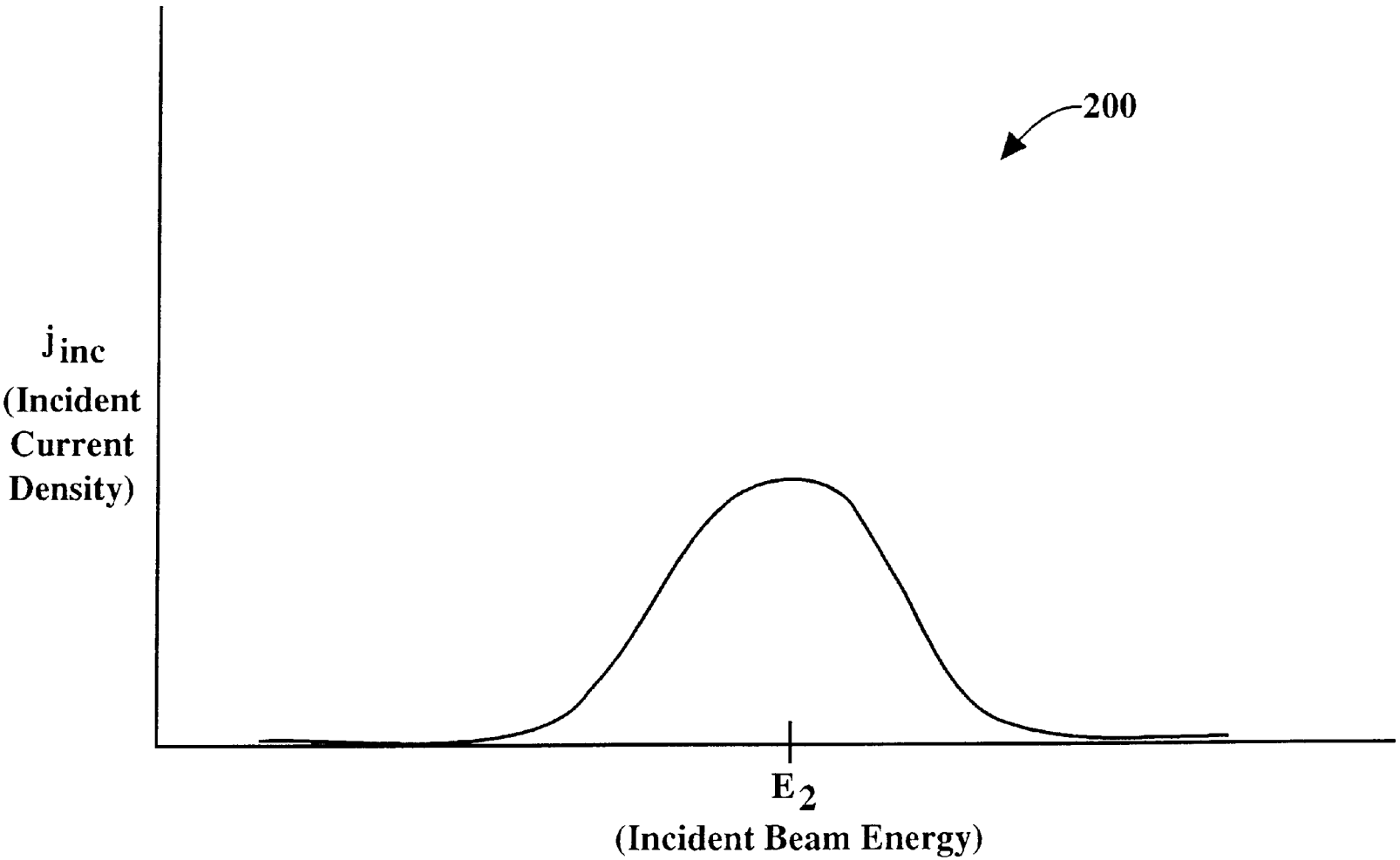
FIG. 2 is a graph of a typical incident current density ($j_{inc}$) vs. incident beam energy (E) impinging at some height along a spacer structure.

Referring next to FIG. 2, a graph 200 of the incident current density ($j_{inc}$) vs. the incident beam energy (E) impinging a coating material is shown. As indicated in graph 100, the incident current density varies near the value, $E_2$. This energy distribution will, of course, vary up the wall.

The present invention minimizes deleterious charging of the spacer structure. The present invention achieves such an accomplishment by keeping δ at or near the value of 1. However, as shown in graph 200 of FIG. 2, δ varies with the incident beam energy, E. Hence, the optimal coating material of the present invention is defined as follows. It is desirable to have a low δ coating which efficiently bleeds charge into the bulk of a resistive spacer, but which does not contribute appreciably to the conductivity of the spacer in the direction parallel to the surface.

Figure 3:
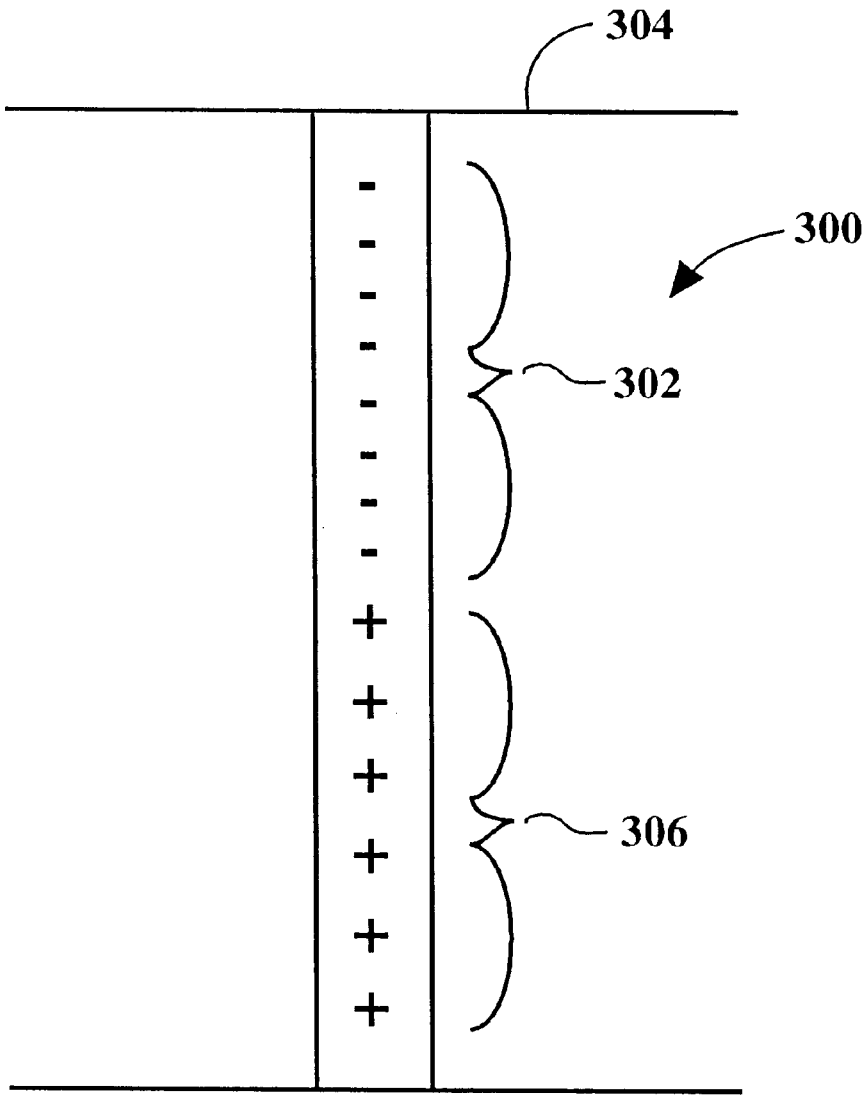
FIG. 3 is a side schematic view of a spacer structure including an illustration of charging properties associated with the spacer structure in accordance with the present claimed invention.

With reference now to FIG. 3, a side schematic view of a spacer structure 300 of the present invention is shown. In such a spacer structure, the upper portion 302 of spacer structure 300 (i.e. near the faceplate 304 of the flat panel display) charges slightly negative. Conversely, the lower portion 306 of spacer structure 300 (i.e. near the cathode) charges slightly positive. That is, electrons striking upper portion 302 of spacer structure 300 typically strike spacer structure 300 with an energy above level $E_2$ of FIG. 2. Because δ(E)<1, upper portion 302 of spacer structure 300 charges negatively. Similarly, electrons striking lower portion 306 of spacer structure 300 strike with energies below level $E_2$ of FIG. 2, and, therefore, charge lower portion 306 of spacer structure 300 positively. However, when considered in its entirety, an energy distribution of electrons having respective energy levels above and below $E_2$ tend to cancel the net charging on spacer structure 300. As a result, the nearby pixel deflection as a function of the net electron current is very small.

Figure 4:
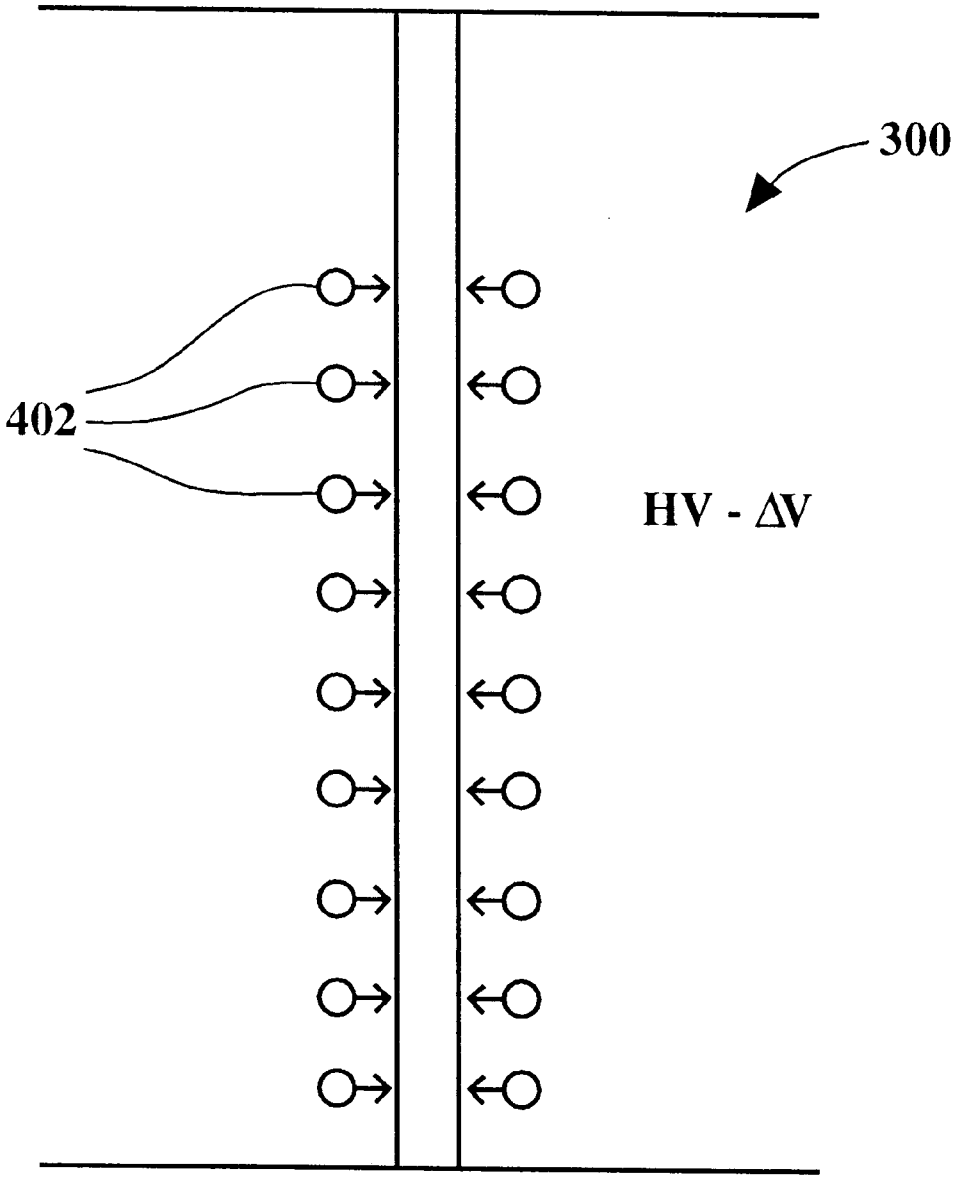
FIG. 4 is schematic top plan view of a spacer structure including an illustration of electron attracting properties associated with a spacer structure in accordance with the present claimed invention having a voltage value of HV−ΔV applied to an adjacent anode.

With reference next to FIG. 4 a schematic top plan view of spacer structure 300 attracting nearby electrons is shown. As mentioned above, net charging on spacer structure 300 of the present invention is nulled. By decreasing the high voltage (HV) value applied to the anode (i.e. faceplate region of the flat panel display), the charging characteristic of spacer structure 300 of the present invention is altered. Specifically, by decreasing HV to HV−ΔV, as shown in FIGS. 1 and 4, spacer structure 300 becomes increasingly positively charged with increasing anode current. As a result, spacer structure 300 of the present invention attracts electrons, typically shown as 402, when a voltage HV−ΔV is applied to the anode. In the present invention, for an HV value of approximately 6000 volts, ΔV typically has a value on the order of 1000 to 2000 volts, or approximately 15–30 percent of the HV value. Although such a value for ΔV is specifically recited above, it will be understood that ΔV could have various other values.

By covering a bulk resistive spacer with a less conductive coating, other advantages are realized by the present invention. Specifically, the advantages of having the spacer conductivity roughly uniform throughout the bulk as opposed to on the surface are maintained. A detailed description of such advantages is set forth in commonly-owned co-pending U.S. patent application Ser. No. 08/684,270 by Spindt et al. entitled "Spacer Locator Design for Three-Dimensional Focusing Structures in a Flat Panel Display". The Spindt et al. application was filed Jul. 17, 1996, and is incorporated herein by reference as background material.

Figure 5:
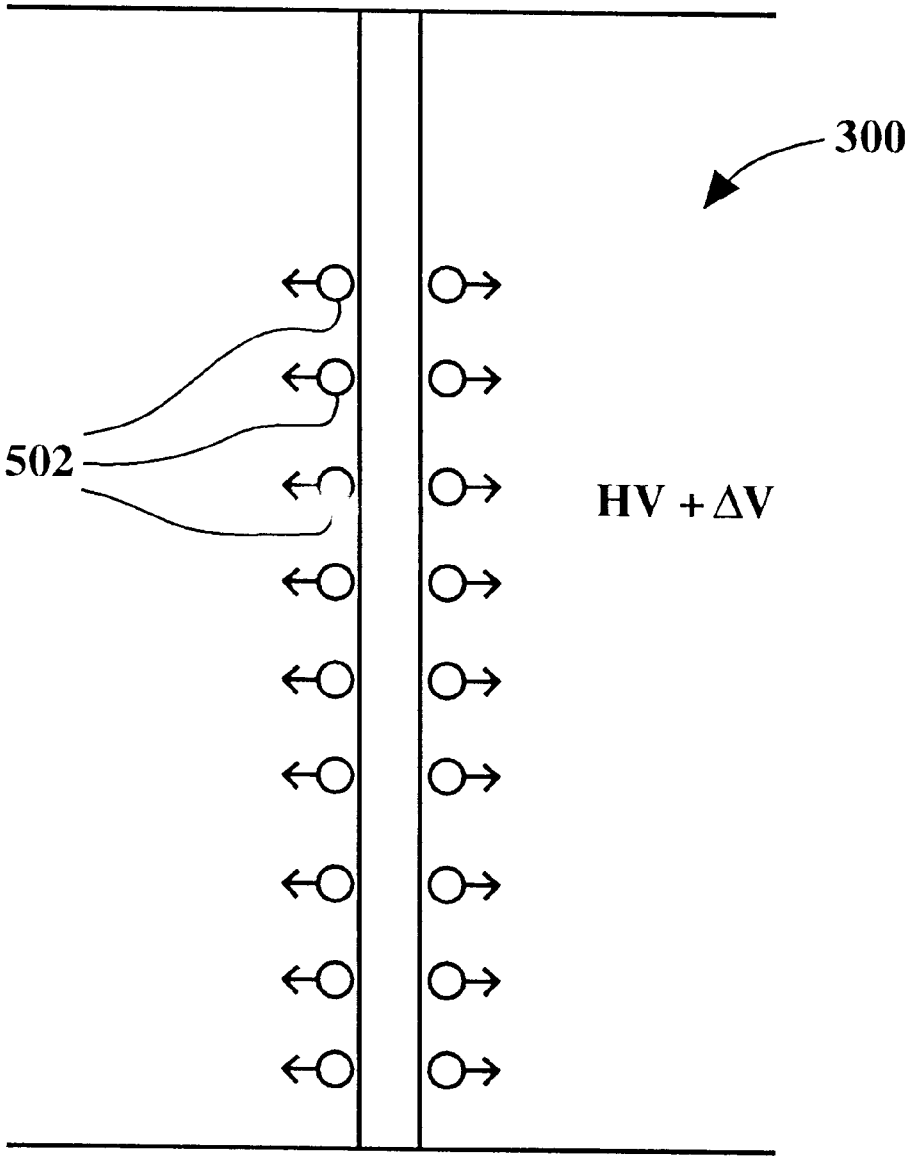
FIG. 5 is schematic top plan view of a spacer structure including an illustration of electron repelling properties associated with a spacer structure in accordance with the present claimed invention having a voltage value of HV+ΔV applied to an adjacent anode.

Referring now to FIG. 5, a schematic top plan view of spacer structure 300 repelling nearby electrons is shown. As mentioned above, net charging on spacer structure 300 of the present invention is approximately nulled. By increasing the high voltage (HV) value applied to the anode, the charging characteristic of spacer structure 300 of the present invention is altered. Specifically, by increasing HV to HV+ΔV, as shown in FIG. 5, spacer structure 300 becomes increasingly negatively charged with increasing anode current. As a result, spacer structure 300 of the present invention repels electrons, typically shown as 502, when a voltage HV+ΔV is applied to the anode. Therefore, a spacer structure having characteristics described above for the present invention, will either attract or repel electrons depending upon the voltage applied to the anode. As mentioned above, in the present invention, for an HV value of approximately 6000 volts, ΔV typically has a value on the order of 1000 to 2000 volts, or approximately 15–30 percent of the HV value.

Figure 6:
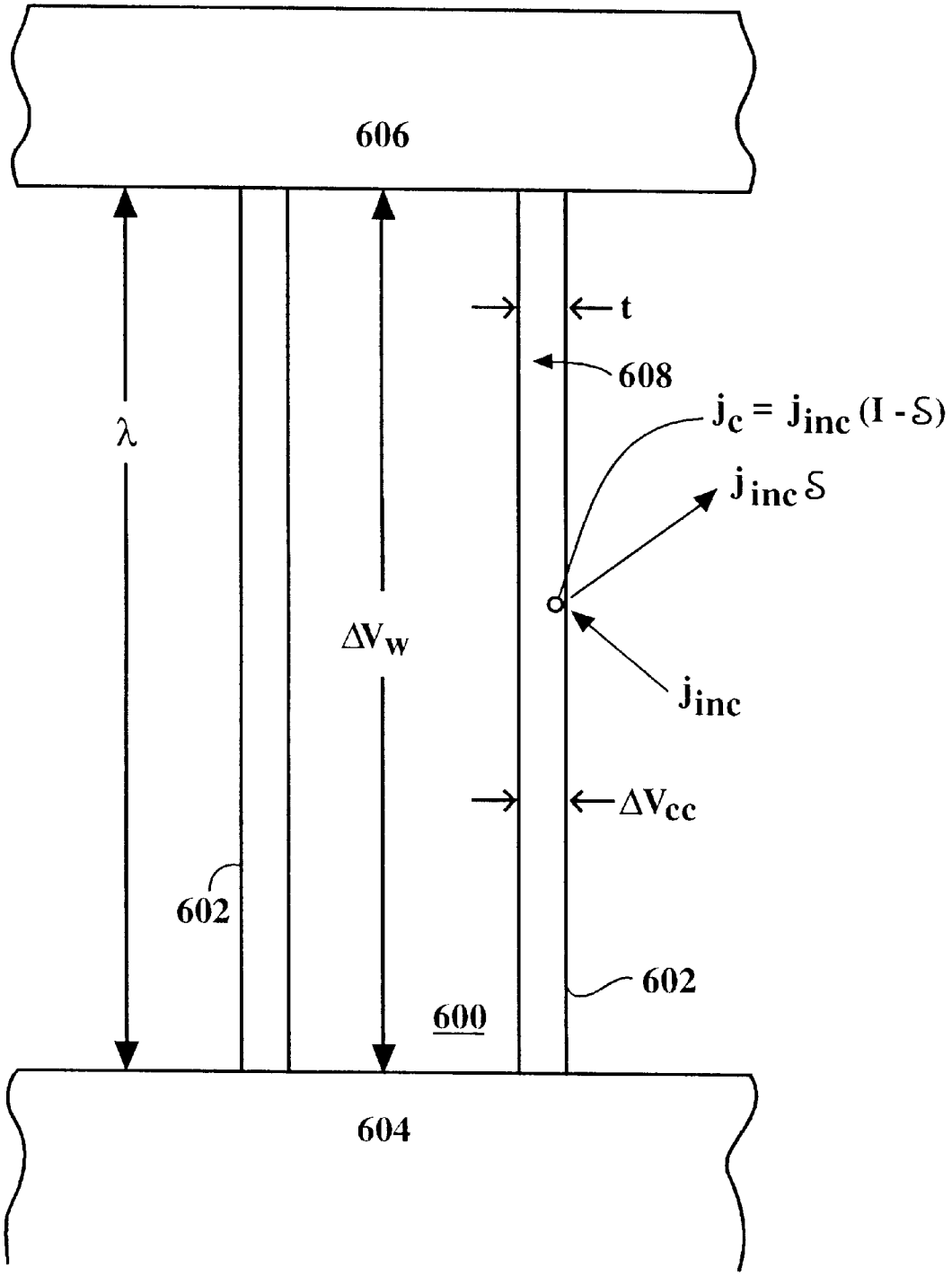
FIG. 6 is a schematic side-sectional view of a spacer structure having a coating material applied thereto in accordance with the present claimed invention.

Referring next to FIG. 6, a spacer 600 having a height, l, is covered by a coating material 602. As stated previously, it is desirable to have a low δ coating which also efficiently bleeds charge into the bulk of a resistive spacer, but which does not contribute appreciably to the conductivity of the spacer in the direction parallel to the surface. Although a wall-type spacer structure is shown in FIG. 6 for purposes of clarity, the present invention is also well suited for use with various other types of spacer structures. Spacer 600 extends between a backplate 604 and a faceplate 606. For estimation purposes, it is useful to look at a uniform charging current $j_c$. Under such conditions and for the case where $\rho_{sc} \gg \rho_{sw}$, the maximum charging voltage, $\Delta V_w$, is given by:

$$\Delta V_w = \frac{\rho_{sw} l^2 j_c}{8} \tag{1}$$

where $\rho_{sw}$ is the sheet resistivity of the bulk spacer 600. The derivation of the value for $\Delta V_w$ is given below in conjunction with FIG. 7.

Figure 7:
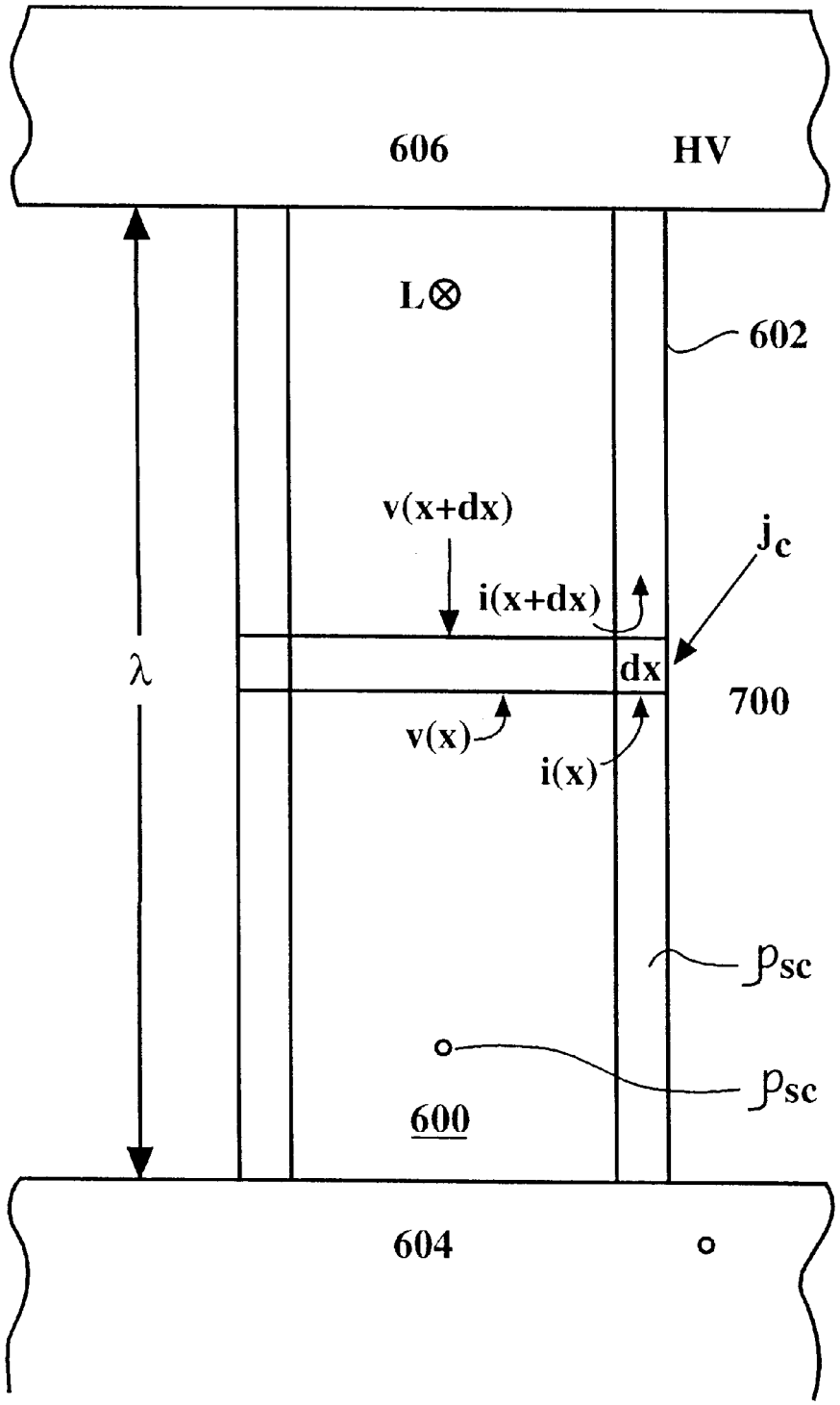
FIG. 7 is a schematic side-sectional view of a spacer structure, including a differential section, dx, having a coating material applied thereto in accordance with the present claimed invention.

With reference now to FIG. 7, a schematic side sectional view of a spacer structure, including a differential section, dx, 700 is shown. In such a configuration, a minimum or low voltage occurs at the base (i.e. at the backplate) of spacer 600 with a maximum or high voltage occurring at the top (i.e. at the anode) of spacer 600. Therefore, the current, i, entering dx 700 is calculated as:

$$i(x)+j_c dxL=i(x+dx) \tag{2}$$

where L is the length of the spacer into the page.

Using the definition of a derivative, equation 2 becomes $$\frac{di}{dx} = j_c L. \tag{3}$$

Similarly, the voltage drop across dx 700 is found using Ohm's law (Voltage=Current×Resistance), i.e. V=IR, to get $$V(x+dx) - V(x) = i(x)\rho_{sc}\frac{dx}{L}. \tag{4}$$

Again, using the definition of a derivative, equation (4) can be solved to provide $$\frac{dV}{dx} = i(x)\frac{\rho_{sc}}{L}. \tag{5}$$

The derivative of equation (5) substituted into equation (3) gives $$\frac{d^2 V}{dx^2} = \rho_{sc} j_c. \tag{6}$$

The solution of equation (6) for the boundary conditions V(l)=high voltage, HV, and V(0)=0 evaluated at x=l/2 is given by:

$$V\left(\frac{1}{2}\right) = \frac{HV}{2} - \frac{\rho_{sw} j_c l^2}{8} \tag{7}$$

where the term $$\frac{\rho_{sw} j_c l^2}{8}$$

is the charging error.

Coating 602 of the present invention has a sheet resistivity, $\rho_{sc}$, which is greater than 100 times the sheet resistivity of spacer 600, $\rho_{sw}$, to which coating material 602 is applied. That is, $$\rho_{sc} > 100\rho_{sw}. \tag{8}$$

By having the sheet resistivity of coating 602 much greater than the sheet resistivity of spacer 600, any deviation of the uniformity of coating 602 on spacer 600 does not substantially effect the sheet resistance uniformity of the combined spacer material and coating structure. For purposes of the present application, uniform resistivity is intended to mean a deviation of less than 2 percent. The optimal coating 602 of the present invention is also well suited to having a lesser sheet resistivity value by accordingly increasing the uniformity of optimal coating material 602. As yet another advantage of the present invention, coating 602 of the present invention renders the voltage, $\Delta V_{cc}$, across coating 602 for a given charging current, $j_c$, small, compared to the charging voltage, $\Delta V_w$, (see equation 1) in the bulk of spacer 600. More, specifically, coating 602 of the present invention has a voltage, $\Delta V_{cc}$, across coating 602 which is $$\Delta V_{CC} < \frac{\rho_{sw} j_c l^2}{8}. \tag{9}$$

That is, $V_{cc}$ is less than the voltage required to bleed the current out through the bulk of the wall. In a simplified view, sheet resistivity is given by resistivity divided by the thickness, t, of the sheet of material, and the sheet resistance, $\rho_{sc}$, of coating 602 is defined as follows $$\rho_{sc} \equiv \frac{\rho_c}{t} \tag{10}$$

where $\rho_c$ is the resistivity of coating material 602 in Ω-cm.

In practice there are non-uniformity, surface, and interfacial effects such that $\rho_{sc}(z)$ is not uniform through the coating and $\rho_{sc} \neq \rho c/t$ (the direction of $\rho_{sc}(z)$ through coating 602 is represented by arrow 608 in FIG. 6). Probably even more importantly, fields on the order of 5 kV/1.25 mm (i.e. 4V/μm) are applied to coating 602 in the "sheet resistance direction" and fields on the order of 500 V/μm are applied in the "area resistance direction." The VCR of the material will mean that we must use the area resistance, r, (at approximately 10 volts across coating 602) of 500 V/μm, and the sheet resistance, r, (at approximately 5 kilovolts along coating 602) of 4 V/μm, instead of the approximations $r = \rho_c t$ and $\rho_{sc} \equiv \rho c/t$. With the above in mind, and by considering the unit area through which the charging current, $j_c$, is applied, it can be written that $$\Delta V_{cc} = j_c r \cong (j_c(A)) \frac{\rho_c t}{A}. \tag{11}$$

By combining the results of equations (9), (10), and (11) $\Delta V_{cc}$, of coating material 602 of the present invention is defined as $$\Delta V_{cc} = j_c r < \frac{\rho_{sw} j_c l^2}{8}. \tag{12}$$

As a result, the area resistance of coating material 602 of the present invention is defined to be $$r < \frac{\rho_{sw} l^2}{8}. \tag{13}$$

Hence, coating material 602 of the present invention has a sheet resistance, $\rho_{sc}$, which is greater than approximately $100(\rho_{sw})$ and an area resistance, r, which is less than approximately $\rho_{sw}$ $(l^2/8)$. Although such a value for r is recited here, it will be understood that the value of r can vary and, as an example, be approximately $r < \rho_{sw}(l^2/80)$. Additionally, in the present embodiment, when a combinational spacer structure and coating material structure is formed, the spacer structure has a bulk resistivity value, and a uniform resistivity along the height/length thereof. That is, in the present embodiment, the spacer structure has a uniform resistivity through its thickness such that the resistivity throughout the thickness of the spacer structure does not vary by more than a factor of 5.

Additionally, the spacer structure has a uniform resistivity along its height such that the resistivity does not vary by more than approximately 2 percent along the height of the spacer structure. Furthermore, in the present embodiment, the spacer structure has a height of approximately 1–2 millimeters, and has a coefficient of thermal expansion similar to the coefficient of thermal expansion of a faceplate and a backplate to which the spacer structure is adapted to be attached (when a wall-type spacer structure is used). In the present embodiment, the faceplate reflects a portion of scattered electrons against the spacer structure. It will be understood that the specific coating may vary depending upon the electron backscatter from the faceplate. Although such values and conditions are used in the present embodiment, the present invention is also well suited to using various other values and conditions for the spacer structure.

Additionally, in the present invention, coating material 602 is formed of a material having low secondary electron emission such as, for example, cerium oxide material. Although such a material forms coating 602 in the present embodiment, the present invention is also well suited to forming coating 602 from, for example, chromium oxide material or diamond-like carbon material. Also, in the present embodiment, coating material 602 is applied to spacer 600 in a layer having a thickness of approximately 200 Angstroms.

Thus, the present invention eliminates the requirement for a spacer material to meet specific resistivity and secondary emission characteristics in addition to meeting requirements such as, for example, high strength, precise resistivity, low TCR, precise CTE, accurate mechanical dimensions and the like. The present invention further achieves a spacer structure which meets the above-described physical and electrical property requirements without dramatically complicating and/or increasing the cost of the spacer structure manufacturing process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

We claim:

1. A material for coating a spacer structure of a flat panel display, wherein said coating material and said spacer combination is characterized by:

a sheet resistance, $\rho_{sc}$, and an area resistance, r, wherein $\rho_{sc}$ and r are defined as:

$\rho_{sc}>100(\rho_{sw})$ and $r<\rho_{sw}(l^2/8)$ wherein $\rho_{sw}$ is the sheet resistance of a spacer to which said coating material is adapted to be applied, wherein l is the height of said spacer.

2. The spacer structure and coating combination of claim 1 wherein said area resistance, r, is less than approximately $\rho_{sw}$ $(l^2/80)$.

3. The coating material of claim 1 wherein said sheet resistance, $\rho_{sc}$, of said coating material has a value approximately 100 times greater than said sheet resistance, $\rho_{sw}$, of said spacer.

4. The coating material of claim 1 wherein said sheet resistance, $\rho_{sw}$, of said spacer has a value of approximately $10^{10}$ to $10^{13}$ $\Omega/\square$.

5. The coating material of claim 1 wherein said coating material adapted to be applied to said spacer is selected from the group consisting of cerium oxide material, chromium oxide material, and diamond-like carbon material.

6. The coating material of claim 1 wherein said coating material, when applied to said spacer, has a thickness of approximately 200 Angstroms.

* * * * *